United States Patent [19]

Roux

[11] Patent Number: 4,542,669

[45] Date of Patent: Sep. 24, 1985

[54] GRIPPING PLIERS

[76] Inventor: Philippe Roux, 41 B rue Pasteur, 69300 Caluire et Cuire, France

[21] Appl. No.: 701,668

[22] PCT Filed: Mar. 17, 1982

[86] PCT No.: PCT/FR82/00047

§ 371 Date: Nov. 17, 1982

§ 102(e) Date: Nov. 17, 1982

[87] PCT Pub. No.: WO82/03195

PCT Pub. Date: Sep. 30, 1982

Related U.S. Application Data

[63] Continuation of Ser. No. 445,368, Nov. 17, 1982, abandoned.

[30] Foreign Application Priority Data

Mar. 18, 1981 [FR] France ..... 81 105689

[51] Int. Cl.[4] ..... B25B 7/02

[52] U.S. Cl. ..... 81/418; 81/367; 81/380

[58] Field of Search ..... 81/418, 302, 367, 368, 81/369, 370, 371, 372, 373, 374, 375, 376, 377, 378, 379, 380

[56] References Cited

U.S. PATENT DOCUMENTS

| | | | |
|---|---|---|---|
| 1,855,944 | 4/1932 | Delacour . | |
| 2,064,457 | 12/1936 | Black | 81/6 |
| 2,299,454 | 10/1942 | Borchers | 81/380 |
| 2,643,565 | 6/1953 | Mount | 81/48 |
| 2,678,189 | 5/1954 | Shelton | 81/302 |
| 2,861,833 | 11/1958 | Nierhaus | 81/302 |
| 3,654,755 | 4/1972 | Bell | 81/302 |
| 4,106,374 | 8/1978 | Dragan | 81/302 |

FOREIGN PATENT DOCUMENTS

| | | | |
|---|---|---|---|
| 536167 | 10/1931 | Fed. Rep. of Germany . | |
| 1119968 | 6/1956 | France . | |
| 39946 | 6/1914 | Sweden | 81/302 |

*Primary Examiner*—Frederick R. Schmidt
*Assistant Examiner*—J. T. Zatarga
*Attorney, Agent, or Firm*—Sandler & Greenblum

[57] ABSTRACT

The pliers comprising a principal lever which is integral with a first fixed jaw, a second jaw being mounted pivotably on the principal lever, and being linked at a second point to the principal lever by an elbow joint, including a link and a portion of said elbow joint functioning to hold the two jaws in gripping position, said pliers being characterized by the ends of the jaws being adapted to form a prehensory or gripping means for hollow elements, said means being capable of gripping the interior of a hollow article, in addition to gripping the exterior of an element between its jaws, wherein the ends of the jaws are adapted to have notches.

10 Claims, 5 Drawing Figures

GRIPPING PLIERS

This application is a continuation of application Ser. No. 445,368, filed Nov. 17,1982, now abandoned.

BACKGROUND OF THE INVENTION

1. Field of the Invention

The present invention relates to gripping pliers of the type commonly referred to as "vice-pliers".

More particularly, this invention is directed to a spring-bias pliers having a flexible lever which is integral with a first fixed jaw, and a second jaw, pivotably mounted to the principal lever. The second jaw is also joined at a second point of the principal lever by an elbow joint or link. The link functions as an auxiliary lever for handling purposes and for blocking the two jaws in a gripping position.

The invention is directed more specifically to pliers, of the above-mentioned type, that include jaws in the form of a tapered vice jaw, intended for the grasping of elements the accessibility to which is difficult.

2. Discussion of Material Information

Vice-type pliers are known. An example of vice-type pliers is commercially available under the trademark "VICE-GRIP". Normally, however, vice-type pliers serve exclusively to grasp the parts and keep them locked between their jaws. They do not permit the manipulation of hollow items or other shapes whose access is only possible through the interior of the hollow element, for example, by the extraction or positioning of cylindrical pieces such as sockets, washers, and screw knobs situated in cavities.

SUMMARY OF THE INVENTION

The invention has as its primary goal the solution to this inconvenience.

The pliers of the present invention are characterized by a gripping means including jaws, the front ends of which are notched to permit the introduction of the external part or edge of the jaws within the interior of the hollow elements or parts to be manipulated or moved. The exterior edge extends posteriorly from the shoulder that follows the notch.

The introduction of the jaws of the pliers is effected after having brought them closer to each other against the force of a spring. The action of the spring causes the jaws to separate as soon as the pressure exerted on the levers of the pliers ceases, so as to contact the element or part positioned around the jaws of the pliers.

BRIEF DESCRIPTION OF THE DRAWINGS

In what follows, the invention is illustrated and described in more detail, while the drawings represent only one embodiment of the invention which is preferred, it is not intended that the invention be limited thereby.

DETAILED DESCRIPTION OF THE DRAWINGS

Figure 1:
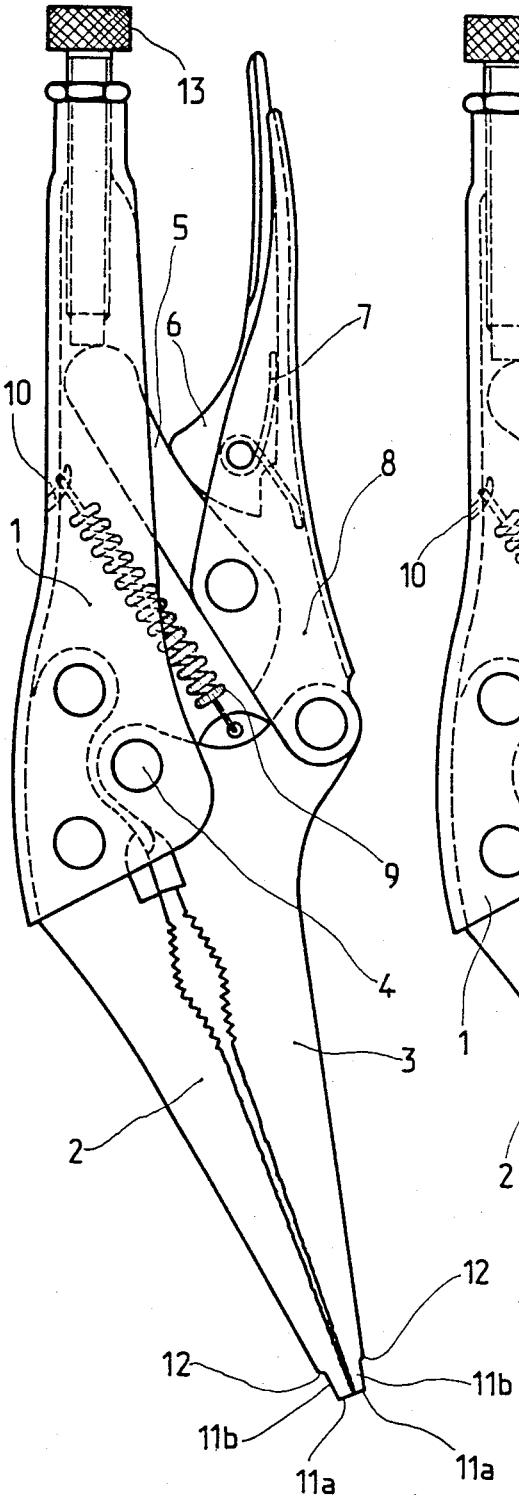
FIG. 1 is an elevational view of pliers according to the invention in a closed position.
Figure 2:
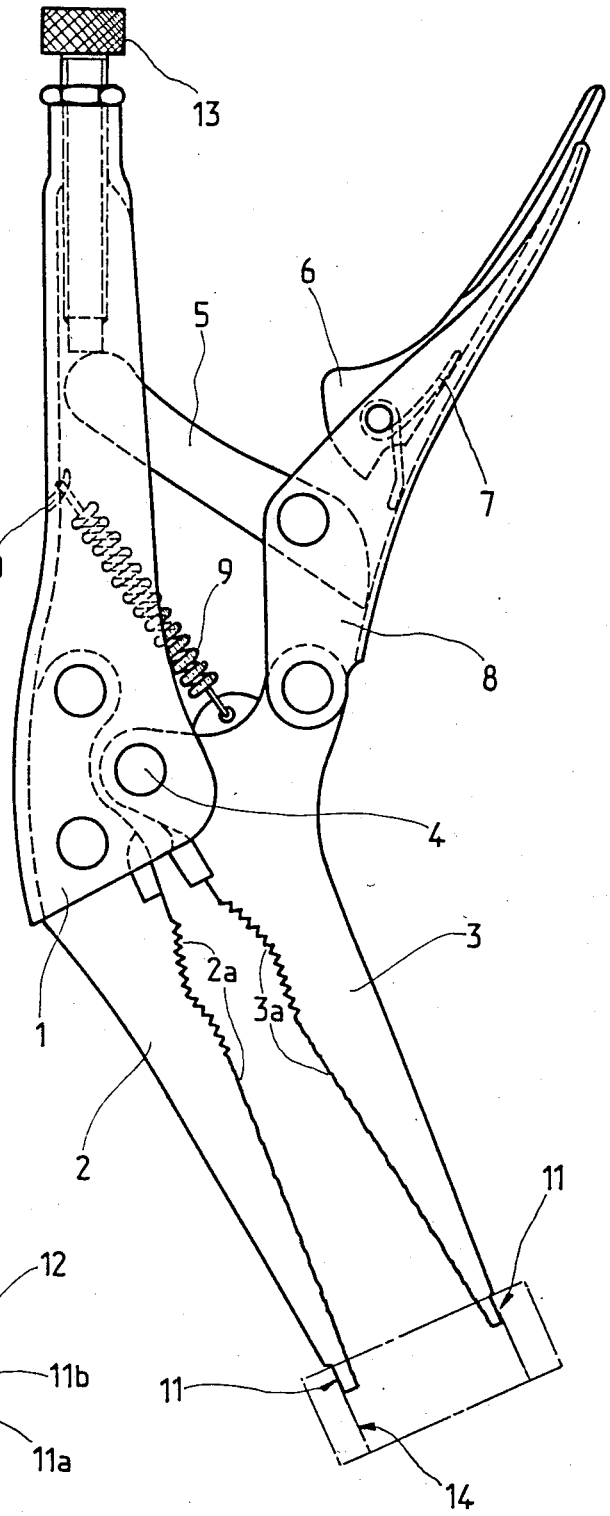
FIG. 2 is an elevational view of the same pliers in a position gripping a hollow element by its interior bore.

The Figures represent pliers that comprise a principal lever 1 in the shape of a cap whose hand is equipped with a fixed jaw 2. A mobile jaw 3 is linked to the fixed jaw by a general axis 4 which is located in the widened part of the lever 1 and by an elbow joint or link 5 whose free end slides in the groove of the cap of the lever 1. A cam 6 with spring 7, journalled in the shank in the form of a cap of the lower jaw 8, ensures the instantaneous unblocking or blocking of the jaws against a spiral spring 9 linking the mobile jaw 3 to a fixed point 10 of the principal lever 1 in a generally known manner.

As can be seen in the drawings, the jaws 2 and 3 are tapered, the interior part being curved to constitute the jaws 2*a*–3*a*.

According to the improvement of the present invention, the extreme exterior part of the jaws 2 and 3 comprises prehensory or gripping means in the form of notches 11. The end 11*a* of notch 11 may be rounded, while its exterior surface 11*b* may be alternatively slightly curved or flat. The shoulder 12 that follows or is posterior to a notch 11 serves as a stop for the borders of the element for the part to be manipulated or extracted from its housing. The curved or flat exterior of the notches may be striated or curved in a manner similar to the jaws 2*a* and 3*a*.

Figure 3:
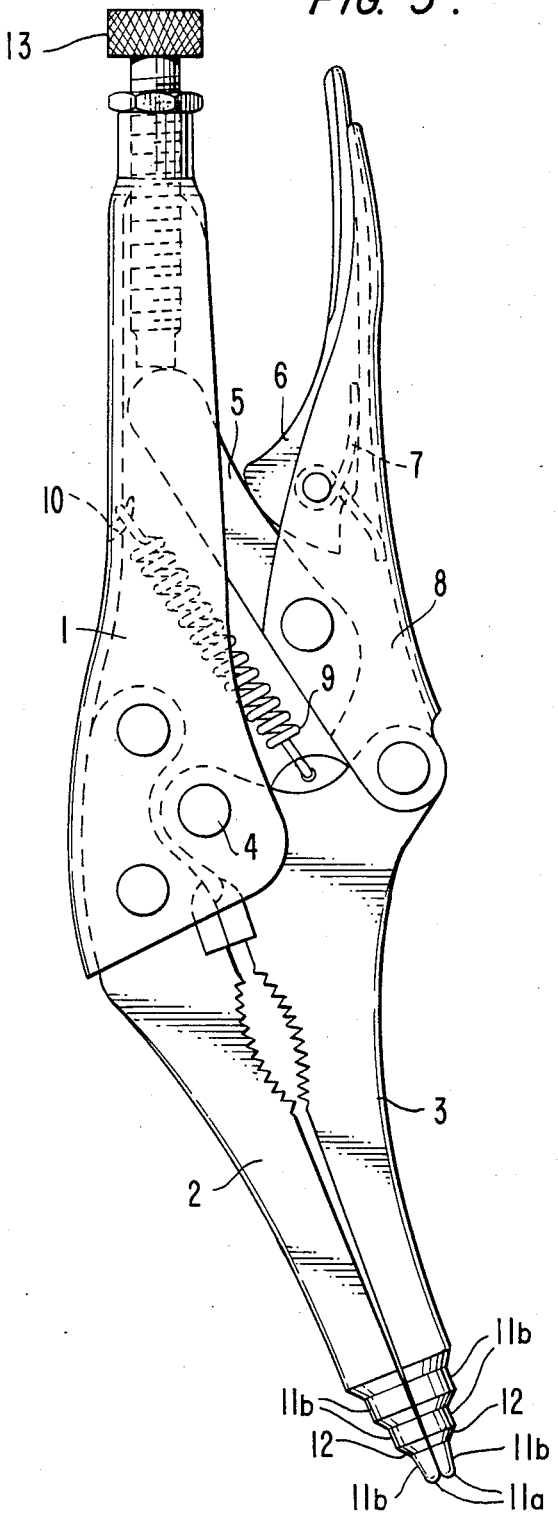
FIG 3 is an elevational view of pliers according to the invention in a closed position showing tapered jaws provided with several notches in a step-wise fashion.
Figure 4:
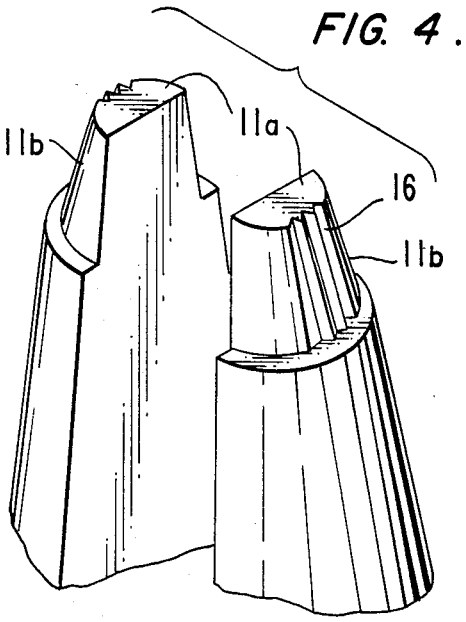
FIG. 4 is an enlarged fragmentary perspective view of the jaw ends of the pliers showing a grooved exterior surface of the notch.
Figure 5:
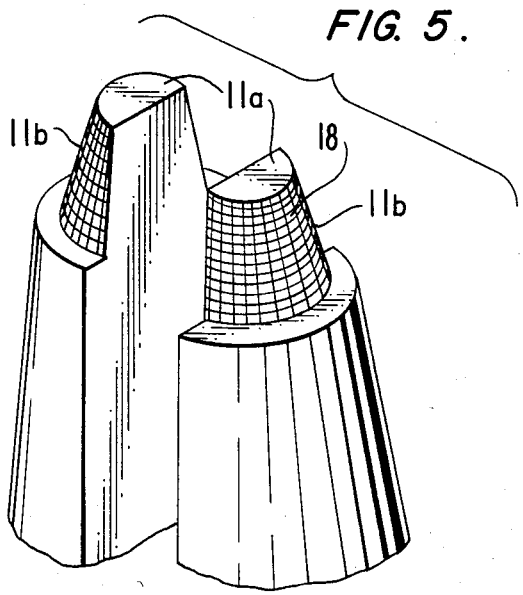
FIG. 5 is an enlarged fragmentary perspective view of the jaw ends of the pliers showing a striated exterior surface of the notch.

In a variation of the embodiment, now shown as FIG. 3, several notches 11 may be provided on each jaw and follow one another in a step-wise fashion to increase the gripping capacity of the pliers.

The opening of the jaws can be adjusted by the roller or adjustment screw 13 of the principal lever 1 which also insures that the pliers remain in an open position.

The functioning of the pliers is very simple, rapid and functional. According to the diameter of the element 14 to be gripped, the jaws are separated more or less with the aid of the adjustment screw 13. Next, the tapered vice jaw is inserted inside the bore of the screw thread of element 14. The mobile lever 8 is then released to as to permit the spring 9 to separate the jaws 2 and 3 to a maximum degree. Otherwise, the mobile lever 8 does not participate in the operation of this device. The curved or flat exterior portion 11*b* of the jaws thus contacts and presses against the interior surface of element 14 whose borders are in abutment against shoulders 12 of the notch. It is easy then to raise element 14 either in order to extract it from a housing, or to position it in a cavity wherein it would otherwise be impossible to manipulate it by its exterior surfaces.

As can be seen, the pliers are useful for the gripping of elements by the exterior as well as by the interior. The pliers of the present invention have a dual function which is doubly advantageous relative to conventional vice-type pliers. Thus, the pliers of the present invention permit the precise manipulation of items which are difficult to handle. In addition they can be used to place hollow articles in rather inaccessible locations, while still retaining their ability to function as conventional pliers.

It is believed that the advantages and improved results furnished by the method and apparatus of the present invention are apparent from the foregoing description of the preferred embodiment of the invention. Various changes and modifications may be made without departing from the spirit and scope of the invention as described in the claims that follow.

I claim:

1. Vice pliers having jaws with ends adapted to grip the interior of hollow articles comprising:

a principal lever which is integral with a first fixed jaw having a notched exterior surface at its front end;

a second jaw having a notched exterior surface at its front end, said second jaw being pivotably connected to said principal lever at a first point, and linked to said principal lever at a second point by means of an elbow joint, said elbow joint forming an auxiliary lever for handling said pliers and a device for locking said first jaw and said second jaw in a gripping position;

a spring connected to said principal lever and said second jaw, said spring exercising a force in order to space said second jaw away from said first jaw so that the notched exterior surfaces of the front end of the jaws are allowed to engage and grip a hollow article into which the jaws are inserted.

2. Pliers according to claim 1, wherein the ends of the jaws are grooved with several notches.

3. Pliers according to claim 1, wherein said at least one notch has a rounded end and a slightly curved exterior surface.

4. Pliers according to claim 1, wherein the exterior surface of said at least one notch is flat.

5. Pliers according to claim 1, wherein the exterior surface of said at least one notch is striated.

6. Pliers according to claim 1, wherein the exterior surface of said at least one notch is polished.

7. Pliers according to claim 1, wherein the exterior surface of said at least one notch is grooved.

8. Pliers according to claim 2, wherein the exterior surface of the notch is striated.

9. Pliers according to claim 2, wherein the exterior surface of the notch is polished.

10. Pliers according to claim 2, wherein the exterior surface of the notches is grooved.

* * * * *